US005259312A

United States Patent [19]

Simeth et al.

[11] Patent Number: 5,259,312

[45] Date of Patent: Nov. 9, 1993

[54] POSITION-STRICT CLAMPING OF A PRINTING PLATE ON A PRINTING CYLINDER

[75] Inventors: Claus Simeth, Offenbach; Karl-Heinz Sellmann, Eltville, both of Fed. Rep. of Germany

[73] Assignee: MAN Miller Druckmaschinen GmbH, Geisenheim, Fed. Rep. of Germany

[21] Appl. No.: 687,912

[22] PCT Filed: Oct. 9, 1990

[86] PCT No.: PCT/EP90/01686

§ 371 Date: Jun. 4, 1991

§ 102(e) Date: Jun. 4, 1991

[87] PCT Pub. No.: WO91/04859

PCT Pub. Date: Apr. 18, 1991

[30] Foreign Application Priority Data

Oct. 9, 1989 [DE] Fed. Rep. of Germany ..... 3933678

[51] Int. Cl.[5] ..... B41F 1/28

[52] U.S. Cl. ..... 101/415.1; 101/378; 101/383

[58] Field of Search ..... 101/415.1, 378, 379, 101/383

[56] References Cited

U.S. PATENT DOCUMENTS

| | | | |
|---|---|---|---|
| 3,583,318 | 6/1971 | Stevenson | 101/415.1 |
| 3,625,151 | 12/1971 | Hart | 101/415.1 |
| 3,750,571 | 8/1973 | Germann | 101/415.1 |
| 3,884,147 | 5/1975 | Abendroth | 101/415.1 |
| 3,913,480 | 10/1975 | Dauner et al. | 101/415.1 |
| 3,946,670 | 3/1976 | Cerny et al. | 101/378 |
| 3,994,224 | 11/1976 | Hill | 101/415.1 |
| 4,006,686 | 2/1977 | Ackerman | 101/415.1 |
| 4,596,188 | 6/1986 | Bonomi | 101/415.1 |
| 4,646,639 | 3/1987 | Gollinger et al. | 101/415.1 |
| 4,724,762 | 2/1988 | Jeschke et al. | 101/415.1 |
| 5,014,619 | 5/1991 | Jeschke | 101/415.1 |
| 5,076,167 | 12/1991 | Herold et al. | 101/415.1 |

FOREIGN PATENT DOCUMENTS

| | | |
|---|---|---|
| 0304646 | 3/1989 | European Pat. Off. . |
| 1198377 | 11/1961 | Fed. Rep. of Germany . |
| 1786317 | 1/1968 | Fed. Rep. of Germany . |
| 2500282 | 7/1976 | Fed. Rep. of Germany . |
| 3843395 | 7/1989 | Fed. Rep. of Germany . |
| 7328877 | 3/1974 | France . |

*Primary Examiner*—Edgar S. Burr
*Assistant Examiner*—Christopher A. Bennett
*Attorney, Agent, or Firm*—Spencer, Frank & Schneider

[57] ABSTRACT

The accurately positioned tensioning of a printing plate on the printing cylinder of a printing mechanism. The circumference of the printing cylinder has a groove extending in the axial direction of the cylinder which accommodates a tensioning and fastening mechanism for the printing plate. The mechanism includes a front tensioning bar for the start of printing of the printing plate and a rear tensioning bar for the end of printing of the printing plate, the rear tensioning bar being disposed ahead of the front tensioning bar in the direction of rotation of the printing cylinder. Releasable fastening of the ends of the printing plate to the two tensioning bars, displacement of the rear tensioning bar in the circumferential direction of the printing cylinder over a longer tensioning path for the purpose of tensioning the printing plate over the circumference of the cylinder, and displacement of the front tensioning bar in the circumferential direction of the printing cylinder over a smaller adjustment path for adjusting the image to be printed are provided for. Adjustment of the printing plate is further facilitated by a stop fixed to the cylinder as the zero position disposed at the side of the front tensioning bar and oriented toward the rear tensioning bar. A spring urges the front tensioning bar against the stop.

7 Claims, 3 Drawing Sheets

POSITION-STRICT CLAMPING OF A PRINTING PLATE ON A PRINTING CYLINDER

BACKGROUND OF THE INVENTION

1. Field of the Invention

The invention relates to an apparatus for the accurately positioned tensioning of a printing plate on the printing cylinder of a printing mechanism, with the circumference of the printing cylinder being provided with a groove that extends in the axial direction of the cylinder so as to accommodate tensioning and fastening means for the printing plate. The tensioning and fastening means include a front tensioning bar for the start of printing of the printing plate and a rear tensioning bar for the end of printing of the printing plate, with the rear tensioning bar being disposed ahead of the front tensioning bar in the direction of rotation of the printing cylinder. Means are provided for the releasable fastening of the ends of the printing plate to the two tensioning bars and means for displacing the rear tensioning bar in the circumferential direction of the printing cylinder over a longer tensioning path for the purpose of tensioning the printing plate over the circumference of the cylinder and means for displacing the front tensioning bar in the circumferential direction of the printing cylinder over a smaller adjustment path for adjusting the image to be printed in the press. The adjustment means for adjusting the printing plate cooperate with a stop fixed to the cylinder as the zero position.

2. Background Information

Such devices are known in many embodiments. As an example, reference can be made to DE-OS (German Laid-Open Patent Application) 3.843,395. This prior art has in common that the stop defining the zero position of the front tensioning bar is the front groove wall. A plurality of tensioning screws are screwed into the front tensioning bar, spaced from one another and distributed over its length. These screws must be set manually so that the zero position of the printing cylinder comes into the desired position as required for the total press run. However, this manner of setting the zero position poses problems. It is not possible to take the front groove wall as such as the zero position because then generally smaller bulges remain in the printing plate over the circumference of the printing cylinder, particularly at the beginning of the printing plate. These bulges can not be compensated even by subsequent tensioning at the rear end of the printing plate because the friction over the entire printing plate, which is already in contact with the printing cylinder, is too high to accomplish this. Modern printing plates are made of a material which must not be tensioned too much in order to prevent it from lengthening to an undue degree. The operator therefore sets the front tensioning bar back by a certain length, starting from the zero position defined by the front groove wall, and then tests it several times until the accurate zero position has been found by the correct setting of all tensioning screws of the front tensioning bar. It is obvious that this is not only labor intensive but also has the particular drawback that the result, in spite of the great labor effort, not always corresponds to the desired outcome, particularly since the zero position defined by the front groove wall had to be relinquished and the position of the front tensioning bar relative to the tensioning screws had to be changed several times, and this generally for all tensioning screws of the front tensioning bar. The noted result is that in the prior art the adjustment of the printing plate at the printing cylinder is not only labor intensive but, in spite of the great effort of labor, the desired zero adjustment is not always realized with sufficient reliability with the consequence of wasted material and renewed labor expenditures for further adjustments.

SUMMARY OF THE INVENTION

The invention avoids these drawbacks. It has as its object to propose an apparatus having the above-mentioned features with which the zero position of the printing plate at the printing cylinder, defining the image to be printed, can be realized reproducibly and accurately with few manipulations.

To solve this problem, the invention is characterized in that the stop that is fixed to the cylinder and constitutes the zero position of the front tensioning bar is disposed at the side of the front tensioning bar oriented toward the rear tensioning bar and spring means are provided to urge the front tensioning bar against the stop.

The position of the front tensioning bar defining the start of printing (zero position) is thus defined by this stop that is fixed to the cylinder and is oriented away from the front groove wall. The zero position defined in this way is reliably attained with the aid of the spring means which urge the front tensioning bar against the stop fixed to the cylinder into the defined zero position.

It should be mentioned that the above cited front groove wall is that groove wall that is disposed adjacent to the front tensioning bar. Seen in the direction of rotation of the printing cylinder, this is the rear groove wall.

The stop fixed to the cylinder will be set correctly once and for all for a certain printing cylinder, with care having to be taken then that the once found setting cannot be easily shifted again. It is therefore preferred for the stop fixed to the cylinder to be adjustable and for it to be possible to lock it in the once set position.

A practical embodiment for this purpose is characterized in that a stop screw is screwed into a threaded bore in a strip fixed to the cylinder and disposed in the groove, with a locking screw lying against the circumference of this stop screw. The tip of the stop screw thus constitutes the stop that is fixed to the cylinder and the once found location of the stop (of the tip of the stop screw) is locked in by the locking screw being appropriately screwed in. This once found and locked position may additionally be secured by suitable means.

It is preferred for the stop and the spring to be oriented coaxially with one another. Then no forces tending to twist the tensioning bar attack the front tensioning bar by way of the spring.

An important feature is characterized in that at least one adjustment screw is provided by means of which the distance between the front tensioning bar and the stop can be set. Generally, it will be sufficient if two such adjustment screws are provided for the front tensioning bar of a cylinder, namely one at the front end and one at the rear end of the tensioning bar.

Actuation is further simplified if a device is provided by means of which all adjustment screws of the cylinder can be actuated jointly. If, for example, two adjustment screws are provided, they may be connected with one another by way of a rod so that they can only be adjusted jointly. Or, the adjustment screws can be changed by way of a common hand lever, or each adjustment screw is provided with such a hand lever.

While, in the prior art, tensioning screws are tightened into the front tensioning strip, the adjustment screws provided in the present invention do not serve the purpose of tensioning the printing plate. They are merely provided to space the front tensioning bar once it and the printing plate hanging from it have been hooked into the cylinder groove, from the stop fixed to the cylinder. Thereafter, the adjustment screws are released and the springs urge the tensioning strip to lie against the stop fixed to the cylinder, thus directly taking up the desired zero position.

BRIEF DESCRIPTION OF THE DRAWINGS

The invention will now be described in greater detail with reference to an embodiment thereof shown in the drawings in which.

DETAILED DESCRIPTION OF THE PREFERRED EMBODIMENT

Figure 1:
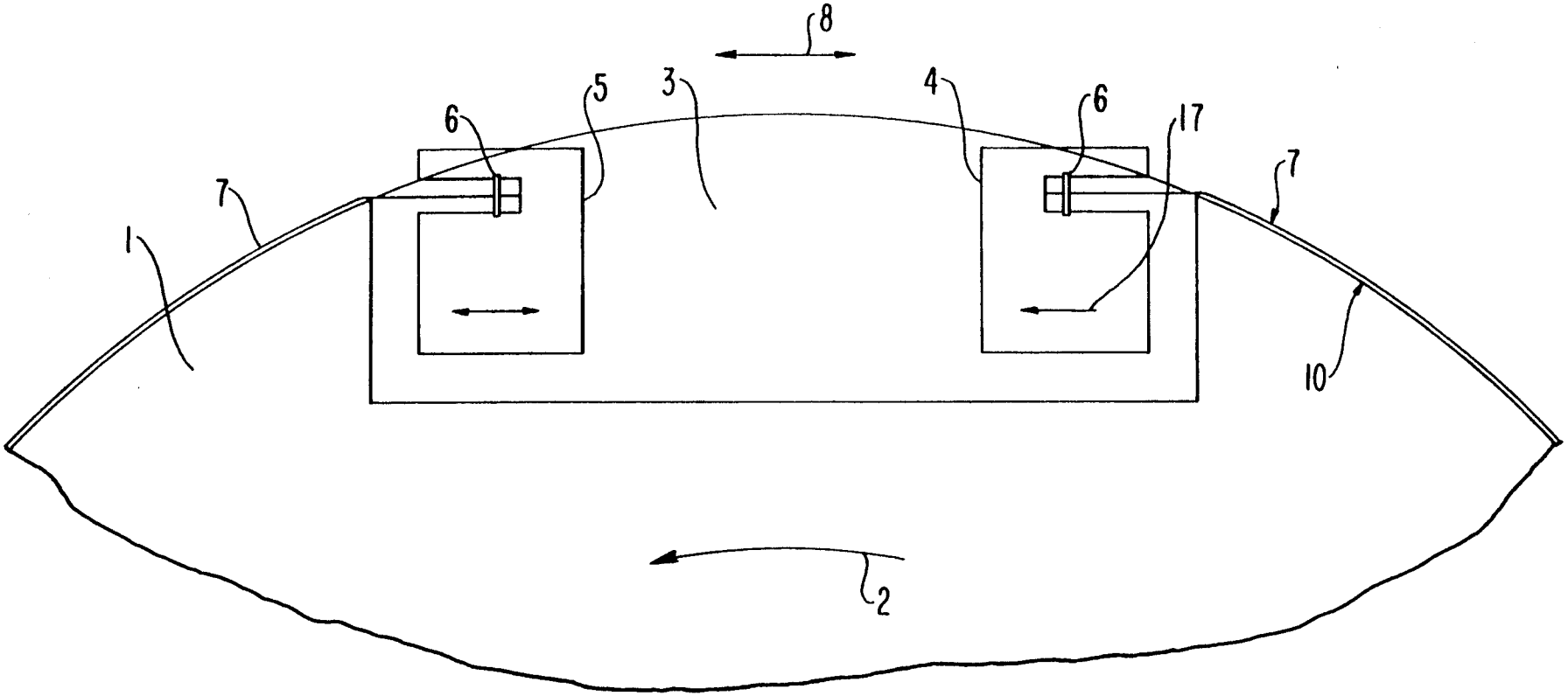
FIG. 1, a schematic front view of a section of the printing cylinder according to the invention in order to explain the basic structure of the tensioning and adjustment means for the printing plate.

FIG. 1 shows in a schematic front view a section of a printing cylinder 1 which rotates in the direction of arrow 2. In the axial direction of the cylinder there extends a cylinder groove 3 which accommodates a front tensioning strip 4 and a rear tensioning strip 5. By way of suitable pins 6, the ends of a printing plate indicated at position 7 are releasably connected with the tensioning strips 4, 5. The pins engage in corresponding holes in the end regions of the printing plate.

Both tensioning strips 4, 5 are displaceable to a certain degree in the circumferential direction, that is, in the direction of double arrow 8. Generally, the rear tensioning strip 5 can be displaced by a greater tensioning path of a few millimeters and the front tensioning strip 4 by a smaller adjustment path of a few tenths of a millimeter. Both tensioning strips 4, 5 are displaceably held in the groove 3 on suitable guides which are not shown in the drawing.

Figure 2:
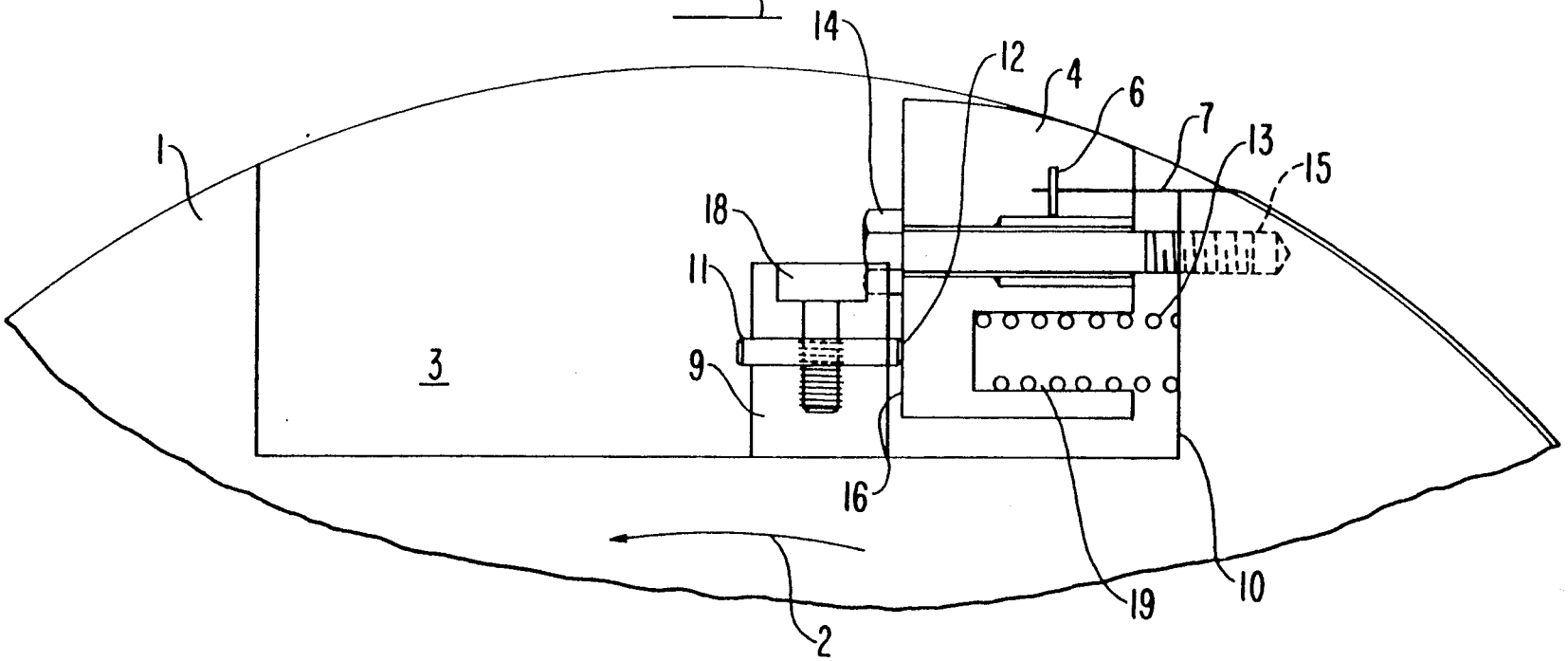
FIG. 2, in a view enlarged with respect to FIG. 1, the configuration according to the invention of the adjustment means for the front tensioning strip.

FIG. 2 shows details of the configuration of the front tensioning strip 4 according to the invention with associated components with which printing plate 7 can take on the zero position in a defined manner.

For this purpose, a strip 9 is fastened at the bottom of cylinder groove 3 and is disposed on the side of tensioning strip 4 facing away from the front groove wall 10. Moreover, several spaced stop screws 11 are screwed into strip 9. See FIG. 3 in this connection in which the stop screws are shown only schematically. The tips 12 of screws 11 thus form a stop 12 that is fixed to the cylinder for the front tensioning strip 4.

The latter is urged by springs 13 against the tips of screws 11. The latter need not be configured as coil springs as shown in the drawing, other spring means are also possible.

Moreover, adjustment screws 14 are inserted into passage holes in tensioning strips 4, with the tips of the screws being screwed into threaded bores 15 in the cylinder.

Once the ends of printing plate 7 have been connected with tensioning strips 4, 5, the tensioning strips are inserted into groove 3, as indicated in FIG. 1. The printing plate is then tensioned by suitably shifting the rear tensioning strip 5 to the right in FIG. 1.

In this position, a distance of, for example, a few tenths of a millimeter exists between the tips 12 of screw 11 and the wall 16 of the front tensioning strip 4 against which it lies.

After tensioning the printing plate, a movement must take place, in order to correctly define the start of printing, into the defined zero position of the front tensioning strip and thus to the start of printing position of printing plate 7. For this purpose, adjustment screws 14 are actuated so that they release the tensioning strip 4, springs 13 push the tensioning strip in the direction of arrow 17 in FIG. 2 and are able to bring it into contact with screws 11. Without further action, the defined and once located zero position has now been taken up.

Figure 3:
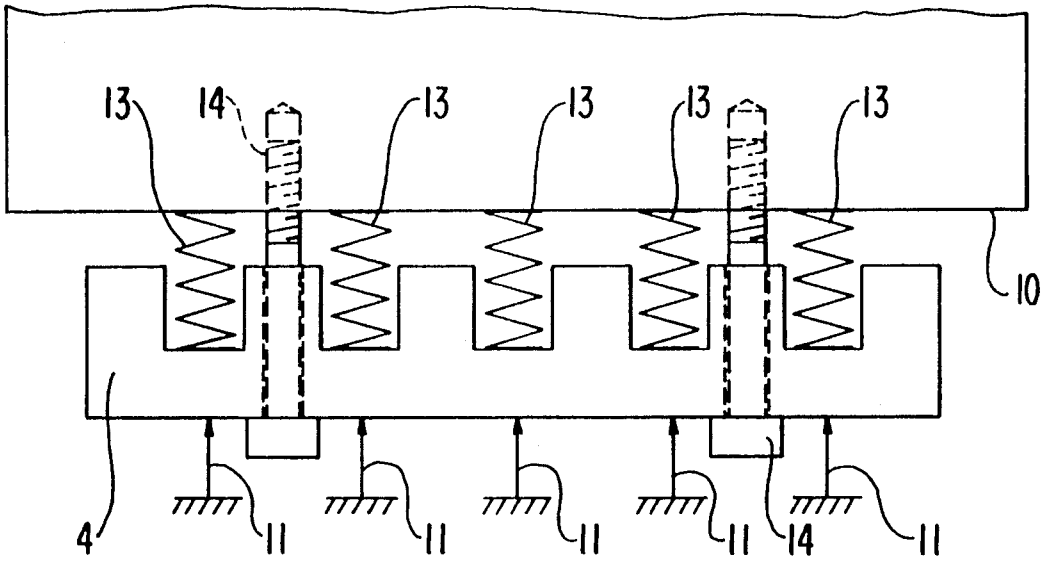
FIG. 3, also schematically, a top view of the arrangement according to FIG. 2.

FIG. 3 also shows that two adjustment screws 14 are enough for each tensioning strip. By means of a suitable device which is not shown in the drawing, the adjustment screws may also be operated jointly.

In the mentioned adjustment of the front tensioning strip 4 it is also possible to compensate for smaller bulges at the front end of the printing plate over the printing cylinder; this is not possible without damage to the printing plate by an adjustment of the rear tensioning strip 5 because of the high friction force between the printing plate and the printing cylinder.

Once screws 11 have located the zero position, it is locked by locking screws 18. The located position can then be secured, for example by means of lacquer.

Advisably, the spring means 13 are accommodated in a suitable receptacle 19 in the tensioning bar or tensioning strip 4.

We claim:

1. An apparatus for effecting accurately positioned tensioning of a printing plate on a printing cylinder of a printing mechanism, comprising:

a printing cylinder having a groove that extends in an axial direction of the cylinder to accommodate tensioning and fastening means for a printing plate, the cylinder having a direction of rotation;

tensioning and fastening means disposed in said groove and including a front tensioning bar for positioning a start of printing location of the printing plate and a rear tensioning bar for positioning an end of printing location of the printing plate, the rear tensioning bar being disposed ahead of the front tensioning bar in the direction of rotation of the printing cylinder;

means for releasably fastening ends of the printing plate to said front and rear tensioning bars, respectively;

a stop fixed to the cylinder for defining a zero position of the front tensioning bar corresponding to the start of printing location of the printing plate, said stop being disposed at a side of the front tensioning bar oriented toward the rear tensioning bar;

spring means disposed for urging the front tensioning bar against the stop; and adjustment means cooperating with said front tensioning bar for adjusting a distance between said stop and said front tensioning bar against the urging of said spring means, said adjustment means being actuatable for releasing said front tensioning bar to close the distance between said front tensioning bar and said stop under the urging of said spring means to place said front tensioning bar at said zero position.

2. An apparatus according to claim 1, further comprising adjusting means disposed for adjusting a position of said stop and locking means disposed for locking said stop in a set position.

3. An apparatus according to claim 2, wherein said stop comprises a stop screw, said adjusting means includes a strip fixed to the cylinder in the groove and having a threaded bore into which said stop screw is screwed, and said locking means includes a locking screw lying against the circumference of said stop screw.

4. An apparatus according to claim 1, wherein said spring means comprises a spring oriented to be coaxial with said stop.

5. An apparatus according to claim 1, wherein said adjustment means includes at least one adjustment screw for adjusting the distance between the front tensioning bar and the stop.

6. A front tensioning bar arrangement for accurately positioning and tensioning a printing plate on a printing cylinder of a printing mechanism, comprising:

a cylinder having a groove with a front wall provided with threaded bores;

a front tensioning bar movably disposed in the groove and having first and second surfaces generally extending in the same direction as the front wall of the groove, the front tensioning bar having means for securing the printing plate thereto and being provided with a plurality of adjusting screws, the adjusting screws extending through the front tensioning bar and into the threaded bores in the front wall of the groove, the adjusting screws for adjustably maintaining the position of the first surface of the front tensioning bar with respect to the front wall of the groove;

a strip fixed in the groove and extending along the second surface of the front tensioning bar opposite the front wall of the groove, the strip having at least one stop means for adjustably stopping movement of the front tensioning bar towards the strip, the stop means comprising a stop screw and an associated locking screw, the stop screw being threaded through the strip and extending towards the front tensioning bar, the stop screw being set to contact the second surface of the front tensioning bar to thereby stop the front tensioning bar when the front tensioning bar is at a desired position relative to the front wall of the groove, the locking screw for securing the stop screw from movement after being set; and at least one spring, disposed between the front wall of the groove and the front tensioning bar, for urging the front tensioning bar towards the strip to contact the stop screw of the at least one stop means.

7. The arrangement according to claim 6, wherein a spring is provided for each respective stop screw and wherein each respective spring is aligned along an axis of a respective stop screw.

* * * * *